US011312149B2

(12) United States Patent
Hizawa et al.

(10) Patent No.: US 11,312,149 B2
(45) Date of Patent: Apr. 26, 2022

(54) PRINTER

(71) Applicant: SEIKO EPSON CORPORATION, Tokyo (JP)

(72) Inventors: Shunichi Hizawa, Matsumoto (JP); Yasuaki Hirai, Shiojiri (JP); Ryo Oguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/027,116

(22) Filed: Sep. 21, 2020

(65) Prior Publication Data

US 2021/0086518 A1 Mar. 25, 2021

(30) Foreign Application Priority Data

Sep. 24, 2019 (JP) ..... JP2019-172658

(51) Int. Cl.
*B41J 2/175* (2006.01)

(52) U.S. Cl.
CPC ..... *B41J 2/17566* (2013.01); *B41J 2/17503* (2013.01); *B41J 2002/17573* (2013.01); *B41J 2002/17589* (2013.01)

(58) Field of Classification Search
CPC ..... B41J 2/17566; B41J 2/17503; B41J 2/17509; B41J 2002/17589; B41J 2002/17573
See application file for complete search history.

(56) References Cited

U.S. PATENT DOCUMENTS

| | | | | |
|---|---|---|---|---|
| 5,818,471 | A | 10/1998 | Shimamura et al. | |
| 6,985,877 | B1 * | 1/2006 | Hayward | G06Q 10/06395 705/7.41 |
| 9,042,746 | B2 * | 5/2015 | Elliott | G03G 15/5016 399/27 |
| 2002/0054340 | A1 * | 5/2002 | Tokutomi | B41J 2/17546 358/1.15 |
| 2013/0028616 | A1 * | 1/2013 | Kunihiro | G06F 3/1229 399/27 |
| 2016/0200115 | A1 | 7/2016 | Niiyama | |
| 2019/0275803 | A1 * | 9/2019 | Miyazawa | B41J 2/17566 |

FOREIGN PATENT DOCUMENTS

| | | |
|---|---|---|
| JP | H07-309016 | 11/1995 |
| JP | 2005-153245 | 6/2005 |
| JP | 2016-129975 | 7/2016 |
| JP | 2016-210101 | 12/2016 |

* cited by examiner

*Primary Examiner* — Sharon Polk
(74) *Attorney, Agent, or Firm* — Workman Nydegger

(57) ABSTRACT

A printer includes: a printing section configured to perform printing using a plurality of printing materials contained in corresponding printing material containers, a display section configured to display respective remaining amounts of the individual printing materials contained in the corresponding printing material containers; and a controller configured to control display on the display section, wherein the controller performs display control so as to match the display on the remaining amount of a second container other than the first container with the display on the remaining amount of a first container having a smallest remaining amount among the plurality of the printing material containers.

8 Claims, 14 Drawing Sheets

PRINTER

The present application is based on, and claims priority from JP Application Serial Number 2019-172658, filed Sep. 24, 2019, the disclosure of which is hereby incorporated by reference herein in its entirety.

BACKGROUND

1. Technical Field

The present disclosure relates to a printer that performs print processing on a medium using a printing material.

2. Related Art

JP-A-2016-129975 discloses a printer as an example of a printer for performing printing by discharging ink, which is an example of a printing material stored in a storage section, which is an example of a printing material container. The printer performs printing on a recording medium by using ink supplied from a plurality of storage sections that store ink of the corresponding different colors with each other. In such a printer, when ink stored in a storage section is used up, it becomes necessary to replace the storage section or replenish the storage section with ink.

The amount of printing material used by a printer for printing differs for each printing material. Accordingly, the time when it becomes necessary to replace a printing material container or replenish a printing material container with a printing material is different for each printing material container. However, when replacement of a printing material container or replenishment of a printing material is performed at separate time for each printing material container, the number of operations by a user is increased.

SUMMARY

According to an aspect of the present disclosure, there is provided a printer including: a printing section configured to perform printing using a plurality of printing materials contained in corresponding printing material containers, a display section configured to display respective remaining amounts of the individual printing materials contained in the corresponding printing material containers; and a controller configured to control display on the display section, wherein the controller performs display control so as to match the display on the remaining amount of a second container other than the first container with the display on the remaining amount of a first container having a smallest remaining amount among the plurality of the printing material containers.

DESCRIPTION OF EXEMPLARY EMBODIMENTS

First Embodiment

Figure 1:
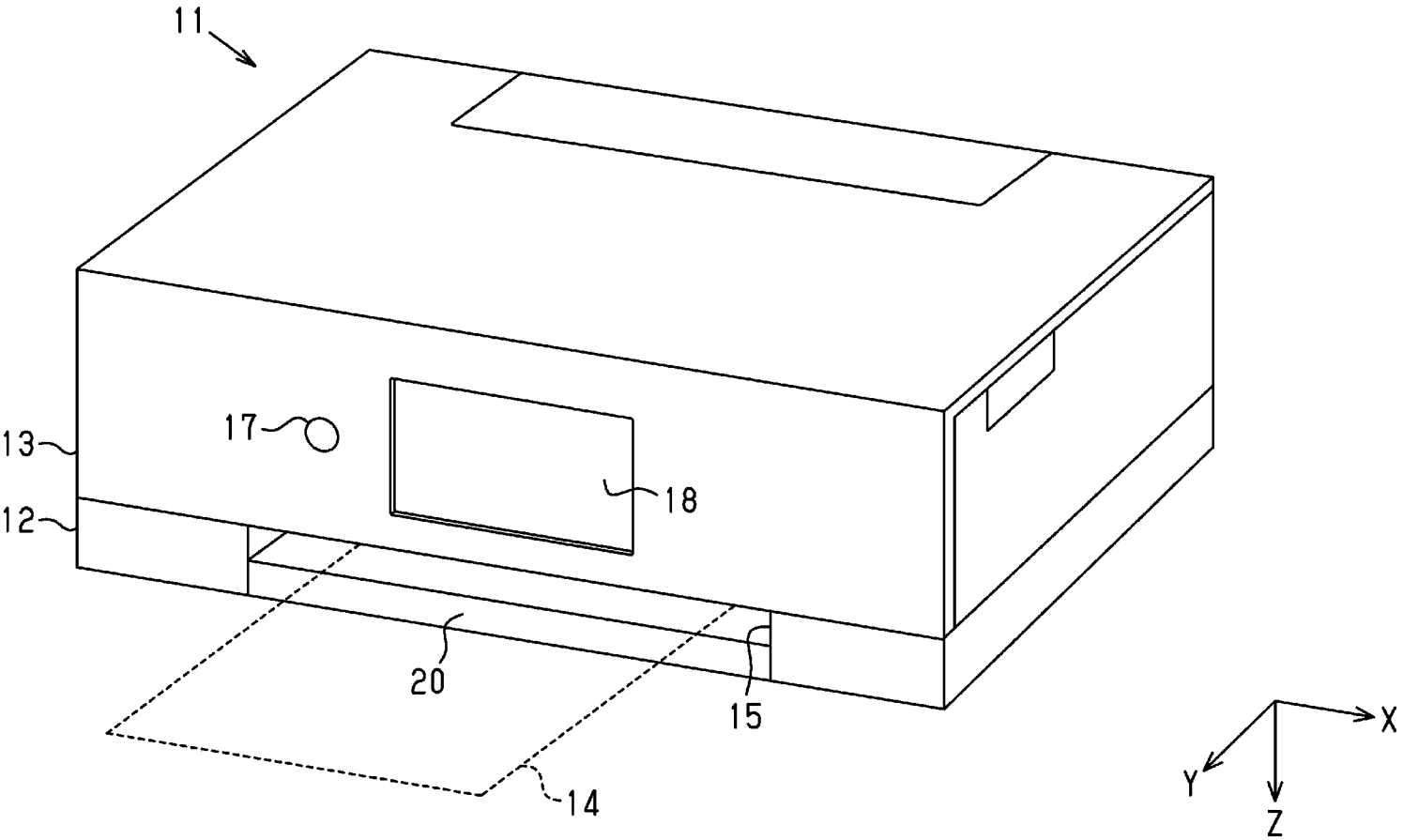
FIG. 1 is a perspective view illustrating a printer according to an embodiment.

In the following, a description will be given of a first embodiment of a printer with reference to the drawings. The printer is an ink jet printer that prints an image, such as characters, photographs, and the like, for example, on paper, which is an example of a medium, by discharging ink, which is an example of a printing material. In the drawings, it is assumed that the printer is placed on a horizontal plane. The gravity direction is denoted by a Z-axis, and directions in the horizontal plane are denoted by an X-axis and a Y-axis. The X-axis, the Y-axis, and the Z-axis are perpendicular to one another.

As illustrated in FIG. 1, a printer 11 includes a casing 12, which is substantially a cuboid, and a cover 13 attached to the casing 12. The cover 13 is attached to the casing 12, for example, via a hinge and thus is openable with respect to the casing 12. The casing 12 is provided with a discharge opening 15 from which a medium 14 is ejected.

The printer 11 includes a power switch 17 operable by a user and a display section 18 that displays information on the printer 11. The display section 18 is, for example, a liquid crystal screen. The display section 18 may be a touch panel. The power switch 17 and the display section 18 are disposed, for example, on the cover 13.

The printer 11 may include a cassette 20 that contains the medium 14. The cassette 20 may be disposed at a position lower than the discharge opening 15 in a detachable manner from the casing 12. The printer 11 performs printing on the medium 14 supplied from the cassette 20 mounted on the casing 12. The printer 11 may be configured such that the medium 14 is able to be supplied from the upper face separately from the cassette 20.

Figure 2:
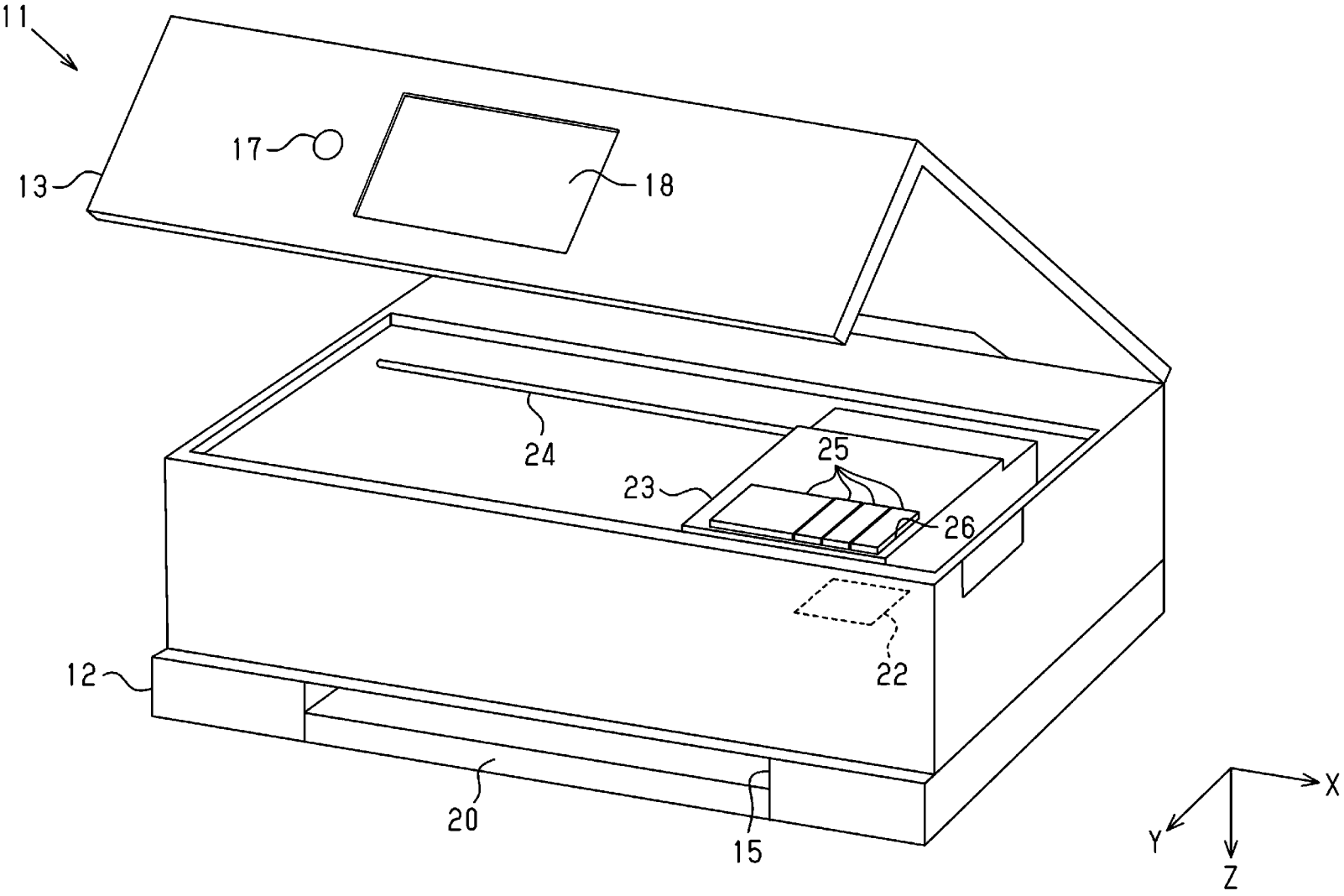
FIG. 2 is a perspective view illustrating the printer with a cover open.

As illustrated in FIG. 2, the printer 11 includes a printing section 22 that performs printing on the medium 14, a carriage 23 on which the printing section 22 is mounted, and a guide shaft 24 that guides the carriage 23. The carriage 23 includes a mounting section 26 on which printing material containers 25 are mounted in a detachable manner.

A plurality of printing material containers 25 are mounted on the mounting section 26. The printing section 22 performs printing using a plurality of printing materials contained in the corresponding printing material containers 25 mounted on the mounting section 26. It is possible to mount four printing material containers 25 that contain printing materials, namely black, cyan, magenta, and yellow respectively on the mounting section 26 according to the present embodiment. The plurality of printing material containers 25 may have the same configuration or may have different containable amounts of printing materials.

Figure 3:
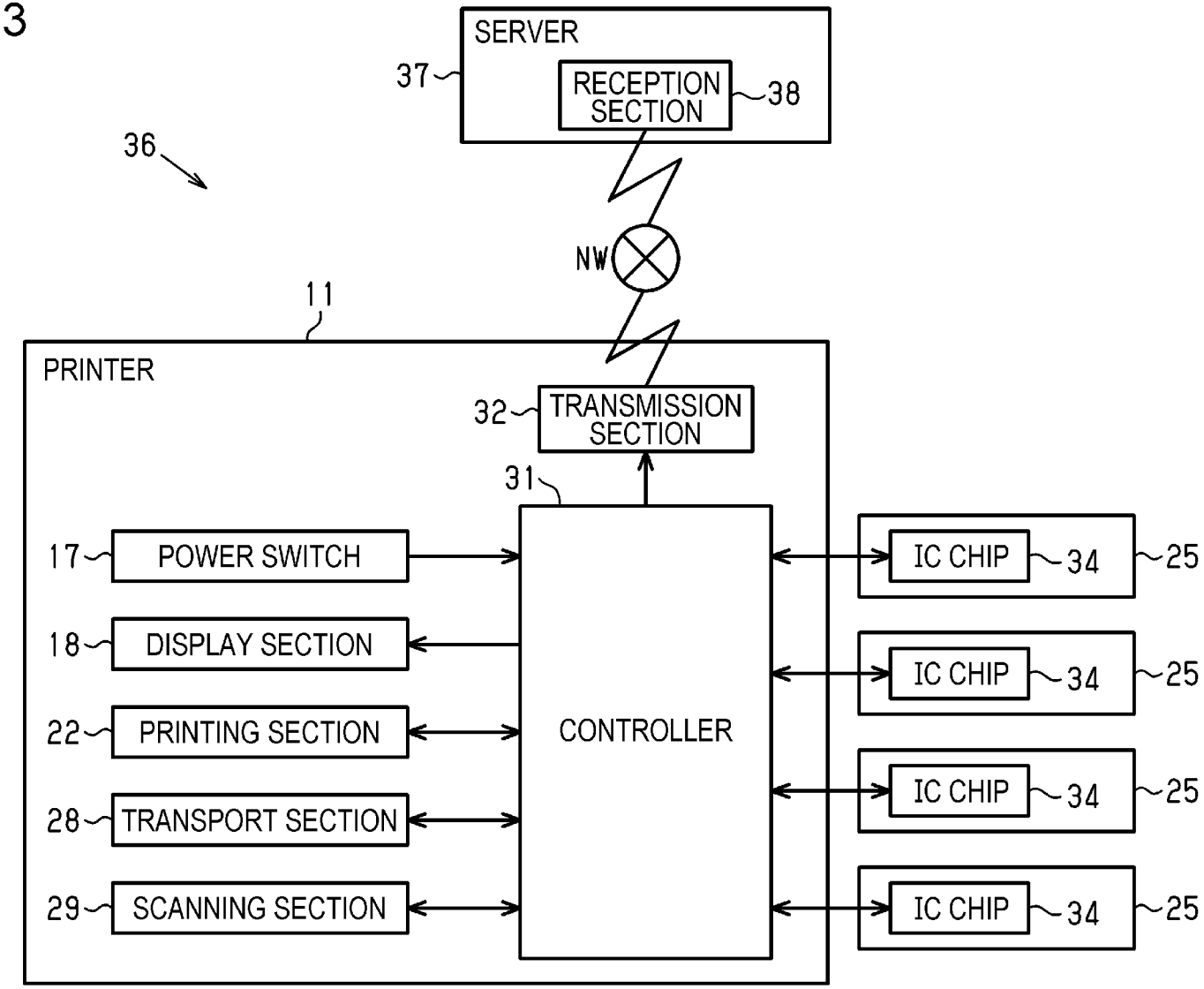
FIG. 3 is a block diagram illustrating a delivery system.

As illustrated in FIG. 3, the printer 11 includes a transport section 28 that transports the medium 14 and a scanning section 29 that scans the carriage 23. The transport section 28 transports the medium 14 from the cassette 20 to the discharge opening 15. The scanning section 29 reciprocally moves the carriage 23 along the guide shaft 24. The printing section 22 that is moved with the carriage 23 performs printing by discharging the printing materials supplied from the respective printing material containers 25 from nozzles not illustrated in the figure onto the medium 14.

The printer 11 includes a controller 31 that controls various operations performed by the printer 11 and a transmission section 32 that transmits signals. The controller 31 includes a processing circuit including, for example, a computer, a memory, and the like, and performs control on the printing section 22 and display of the display section 18 in accordance with a program stored in the memory, or the like. The transmission section 32 is connected to a network NW in a wireless or wired manner.

The controller 31 is configured to obtain container information on the plurality of printing material containers 25 and the remaining amount information on the amounts of the printing materials contained in the corresponding printing material container 25 for each of the printing material containers 25. The container information and the remaining amount information are stored the respective IC chips 34 included in the corresponding printing material containers 25. The controller 31 is electrically coupled to the respective IC chips 34 of the corresponding to printing material containers 25 mounted on the mounting section 26.

The printer 11 constitutes a part of a delivery system 36. That is to say, the delivery system 36 includes a printer 11 and a server 37 on the network NW. The server 37 includes a reception section 38 that receives information transmitted from the printer 11. The delivery system 36 may include a plurality of printers 11, and a plurality of printers 11 may be connected to the server 37. Each of the printers 11 is connected to the server 37 via the network NW.

The printer 11 supplies the printing materials contained in the respective printing material containers 25 to the printing section 22, and uses the printing materials for printing on the medium 14 and maintaining the printing section 22. When a printing material container 25 runs out of the printing material to be supplied, it becomes necessary to perform replacement or replenishment of the printing material. The delivery system 36 may deliver a replacement container that takes the place of a printing material container 25, which has been required to be replaced in the printer 11, or a replenishment container, which replenish the printing material container 25 with the printing material, to a user who uses the printer 11. When the server 37 receives a request signal transmitted from the printer 11 for requesting replacement of a container or replenishment of the container, the server 37 may arrange delivery of a replacement container or a replenishment container.

The controller 31 may store a delivery threshold value, a preannouncement threshold value, and a necessary threshold value. The delivery threshold value, the preannouncement threshold value, and the necessary threshold value are values that are compared with the remaining amount of the printing material contained in the printing material container 25 and are used by the controller 31 to determine the states of the respective printing material containers 25.

The delivery threshold value is a value for requesting delivery of a replacement container that takes the place of a printing material container 25 mounted on the mounting section 26 or a replenishment container. A delivery threshold value according to the present embodiment is higher than a preannouncement threshold value. However, a delivery threshold value may be equal to a preannouncement threshold value or a necessary threshold value, or may be lower than a preannouncement threshold value. A preannouncement threshold value is higher than a necessary threshold value by a predetermined amount, and is a value suitable for preannouncing the necessity for replacement of a printing material container 25 or replenishment of a printing material. Here, it is desirable to set a predetermined amount to 5% to 30% the printing material amount containable in a corresponding printing material container 25. A necessary threshold value is a value necessary for replacement of a printing material container 25 or replenishment of a printing material.

The delivery threshold value, the preannouncement threshold value, and the necessary threshold value may be set in advance of may be set by a server 37, a user, or the like. For example, the delivery threshold value may be a value calculated from the usage speed of the printing material and time required for the delivery of a replacement container or a replenishment container. Specifically, the server 37 may obtain area information on the area in which the printer 11 is used and speed information on the usage speed of a printing material from the printer 11, and may store the product of the usage speed and the time required for the delivery in the controller 31 as a delivery threshold value.

Figure 4:
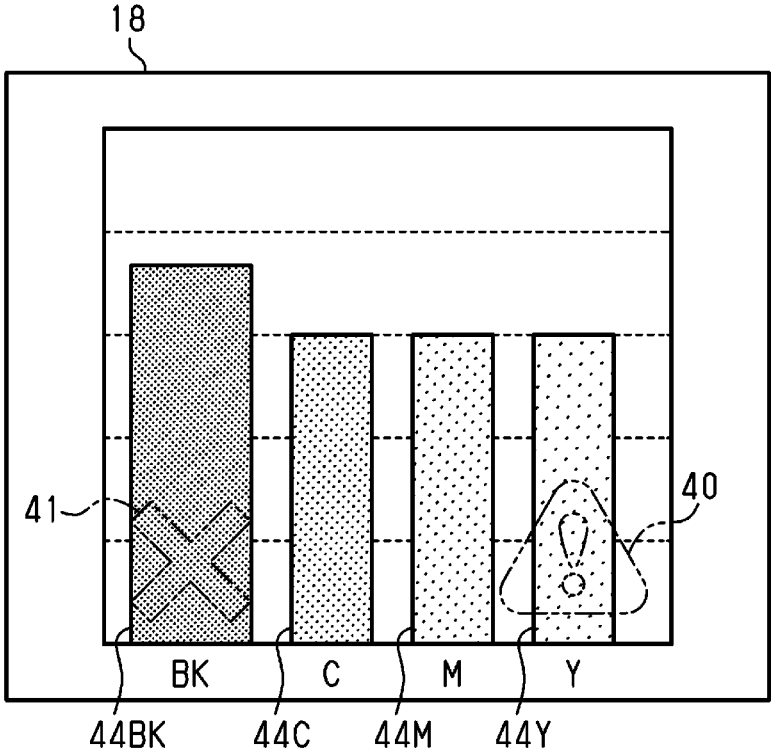
FIG. 4 is a schematic diagram illustrating a display section that displays remaining amounts.

As illustrated in FIG. 4, the controller 31 displays the remaining amount of each printing material contained in the plurality of printing material containers 25 onto the display section 18. The controller 31 may display a preannouncement mark 40 for preannouncing the necessity of replacement or replenishment of the printing material container 25 and an empty mark 41 indicating that a printing material container 25 has become empty and replacement or replenishment is necessary at a suitable time onto the display section 18.

As illustrated in FIG. 4, the controller 31 displays the remaining amount of a black printing material 43BK, a cyan printing material 43C, a magenta printing material 43M, and a yellow printing material 43Y, for example, by a bar graph. That is to say, the controller 31 displays the ratio of the remaining amount to the printing material amount containable in the corresponding to printing material container 25, or to the maximum capacity, which is the printing material amount contained in the corresponding unused printing material container 25 by a data marker for each of the printing materials 25. Specifically, the controller 31 displays a black marker 44BK indicating the remaining amount of the black printing material 43BK, a cyan marker 44C indicating the remaining amount of the cyan printing material 43C, a magenta marker 44M indicating the remaining amount of the magenta printing material 43M, and a yellow marker 44Y indicating the remaining amount of the yellow printing material 43Y side by side onto the display section 18. The width of the black marker 44BK, the cyan marker 44C, the magenta marker 44M, and the yellow marker 44Y may be set in accordance with the maximum capacity of each printing material container 25.

Figure 5:
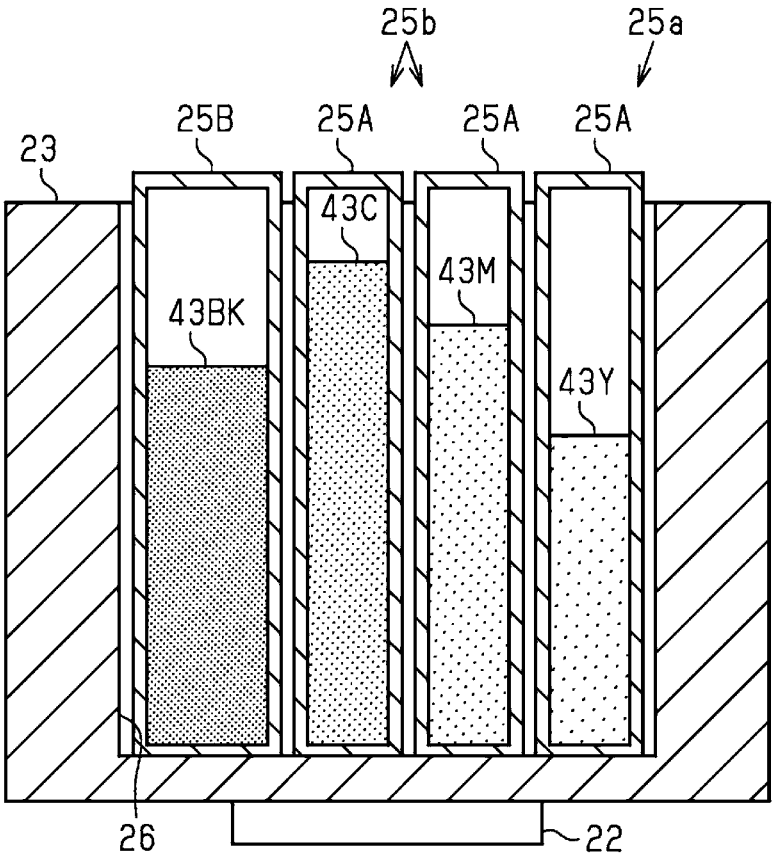
FIG. 5 is a schematic sectional view illustrating printing material containers mounted on a mounting section.

As illustrated in FIG. 5, the printing material containers 25 usable by the printer 11 include containers of a subscription method and of a purchase method. The subscription method is a method in which a user pays the charge in accordance with the usage period of the printer 11 and the number of printed sheets regardless of the amount of the printing material used. The purchase method is a method in which a user pays the charge for the printing material containers 25. In the present embodiment, a printing material container 25 of the subscription method is also referred to as a flat-rate container 25A, and a printing material container 25 of the purchase method is also referred to as a marketed container 25B. The IC chip 34 stores either first information indicating the flat-rate container 25A as container information or second information indicating the marketed container 25B.

The mounting section 26 may be mounted with a combination of the flat-rate container 25A and the marketed container 25B, or a plurality of flat-rate containers 25A, or a plurality of marketed containers 25B. In FIG. 5, a printing material container 25 that contains the black printing material 43BK is the marketed container 25B, and printing material containers 25 that contain the cyan printing material 43C, the magenta printing material 43M, and the yellow printing material 43Y are the flat-rate containers 25A.

Next, a description will be given of a remaining amount display routine performed by the controller 31 with reference to the flowcharts in FIGS. 6 to 8. The remaining amount display routine is executed at the time when the power switch 17 is operated to turn on the power to the printer 11 and at the time when the printing material container 25 is mounted on the mounting section 26 in the power on state.

Figure 6:
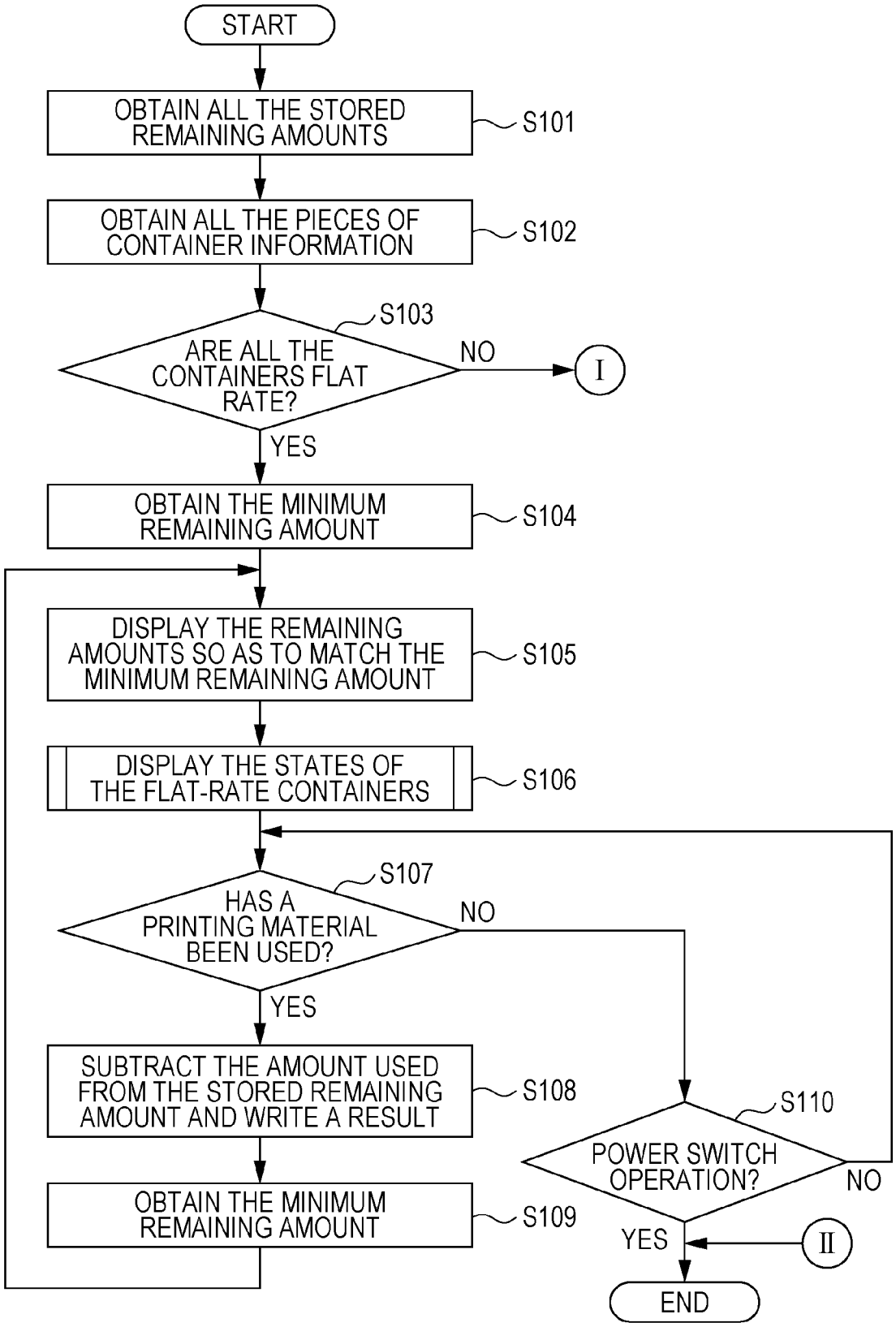
FIG. 6 is a flowchart illustrating a remaining amount display routine.

As illustrated in FIG. 6, in step S101, the controller 31 obtains stored remaining amounts, which are the remaining amounts stored in the respective IC chips 34 for all the printing material containers 25 mounted on the mounting section 26. In step S102, the controller 31 obtains the container information on all the printing material containers 25 mounted on the mounting section 26.

In step S103, the controller 31 determines whether the printing material container 25 mounted on the mounting section 26 is the flat-rate container 25A or the marketed container 25B. That is to say, the controller 31 determines that the printing material container 25 having the first information as the flat-rate container 25A and determines the printing material container 25 having the second information as the marketed container 25B based on the container information obtained in step S102.

When all of the plurality of printing material container 25 are the flat-rate containers 25A, the processing of the controller 31 proceeds to YES in step S103, and the processing proceeds to step S104. When the plurality of printing material containers 25 includes the marketed container 25B, the processing of the controller 31 proceeds to NO in step S103, and the processing proceeds to step S201 in FIG. 7.

In step S104, the controller 31 obtains the smallest amount among the stored remaining amounts stored in the respective IC chips 34 included in the plurality of printing material containers 25 mounted on the mounting section 26 as the minimum remaining amount. In step S105, the controller 31 displays the remaining amounts of the plurality of printing material container 25 to match the minimum remaining amount. Accordingly, the display remaining amounts displayed on the display section 18 become equal regardless of variations of the current remaining amounts.

Figure 9:
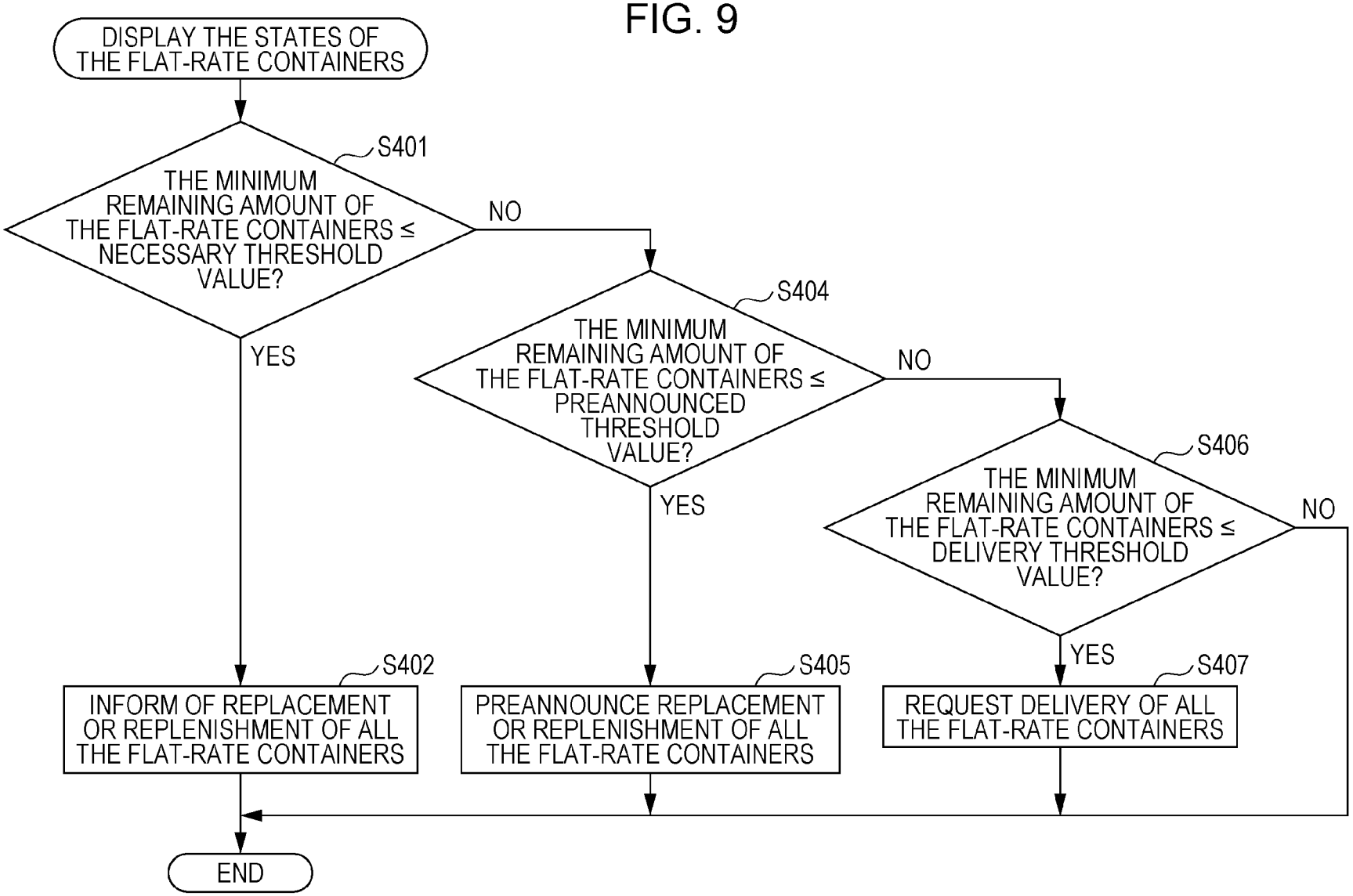
FIG. 9 is a flowchart illustrating a state display routine of a flat-rate container.

In step S106, the controller 31 executes a subroutine illustrated in FIG. 9 for displaying the state of the flat-rate container 25A. In step S107, the controller 31 determines whether or not the printer 11 has performed printing or maintenance, and the printing material has been used. When the printing material has been used, the processing of the controller 31 proceeds to YES in step S107, and the processing proceeds to step S108.

In step S108, the controller 31 subtracts amounts used from the respective stored remaining amounts stored in the IC chips 34 and updates the stored remaining amounts by writing new current remaining amounts in the IC chips 34. The controller 31 updates the stored remaining amount for each of the printing material containers 25. That is to say, the controller 31 subtracts the amount of black printing material 43BK used from the stored remaining amount stored in the IC chip 34 included in the black printing material container 25 and writes the difference in the IC chip 34. When the controller 31 updates the remaining amounts for all the printing material containers 25 in the same manner, the processing proceeds to step S109.

In step S109, the controller 31 obtains the smallest current remaining amount among the current remaining amounts contained in the plurality of respective printing material containers 25 as the minimum remaining amount. That is to say, the controller 31 calculates the current remaining amount produced by subtracting the amount of the corresponding printing material used from the stored remaining amount in the IC chip 34, and obtains the smallest current remaining amount among the plurality of printing material containers 25 as the minimum remaining amount. After the controller 31 executes step S109, the processing proceeds to step S105.

In step S107, when no printing materials have been used, the processing of the controller 31 proceeds to NO in step S107, and the processing proceeds to step S110. In step S110, the controller 31 determines whether or not a user has operated the power switch 17. When the power switch 17 has not been operated, the processing of the controller 31 proceeds to NO in step S110, and the processing proceeds to step S107. When the power switch 17 has been operated, the processing is terminated, and the power to the printer 11 is turned off.

Figure 7:
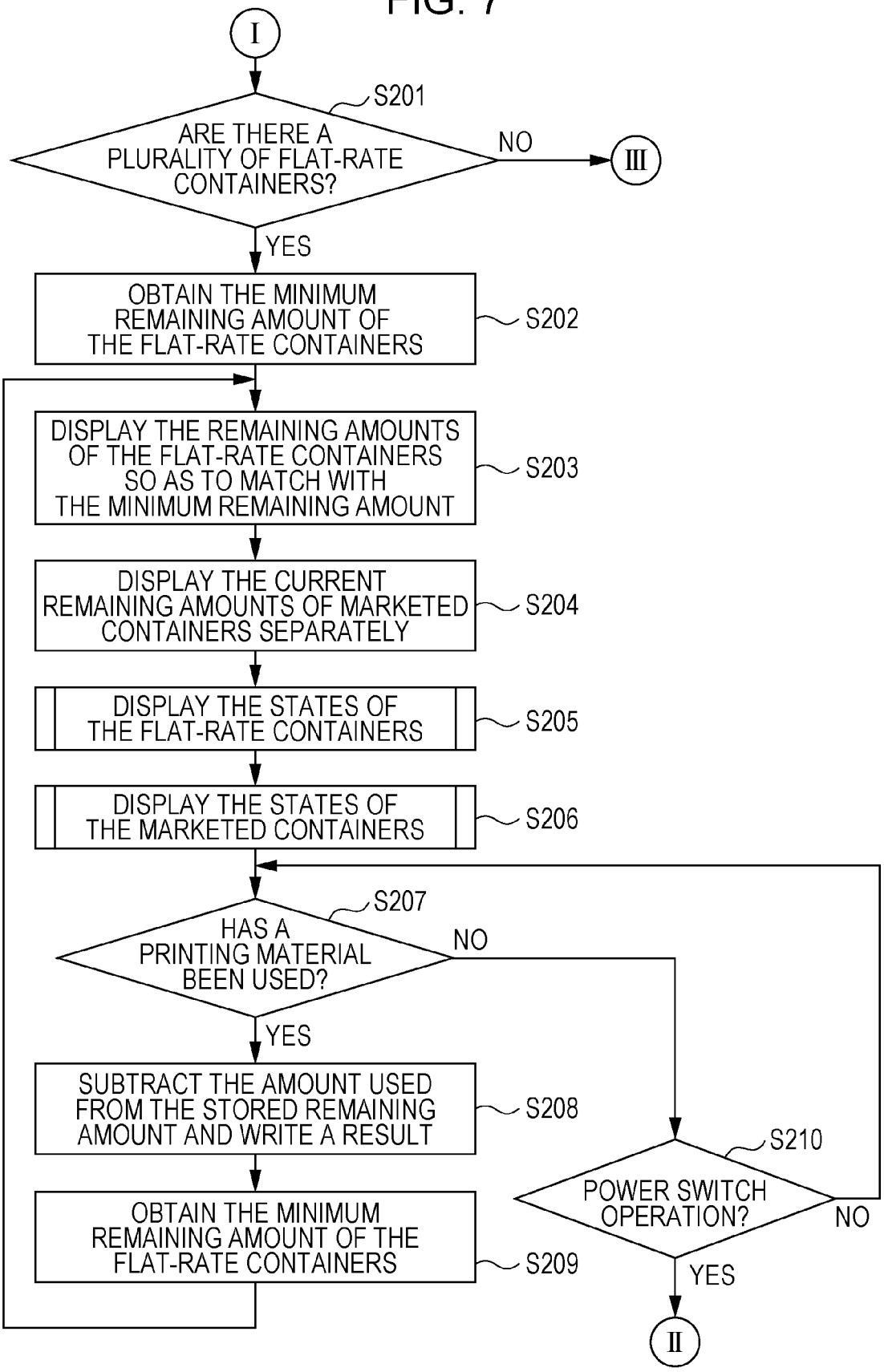
FIG. 7 is a flowchart illustrating the remaining amount display routine.

As illustrated in FIG. 7, in step S201, the controller 31 determines whether or not the printing material containers 25 mounted on the mounting section 26 include a plurality of the flat-rate containers 25A. When a plurality of the flat-rate containers 25A are included, the processing of controller 31 proceeds to YES in step S201, and the processing proceeds to step S202. When one or all of flat-rate containers 25A are all the marketed containers 25B, the processing of the controller 31 proceeds to NO in step S201, and the processing proceeds to step S301 illustrated in FIG. 8.

In step S202, the controller 31 obtains the minimum remaining amount for the flat-rate container 25A. That is to say, the controller 31 obtains the smallest amount among the current remaining amounts of the flat-rate containers 25A as the minimum remaining amount.

In step S203, the controller 31 displays the remaining amounts of the plurality of flat-rate containers 25A by matching with the minimum remaining amount. Accordingly, among the remaining amounts of the plurality of printing material containers 25, the display remaining amounts on the flat-rate containers 25A become equal regardless of variations of the current remaining amounts.

In step S204, among the plurality of printing material containers 25, the current remaining amounts of the marketed containers 25B are separately displayed. Accordingly, the display remaining amounts on the marketed containers 25B match the current remaining amounts.

In step S205, the controller 31 executes a subroutine, illustrated in FIG. 9, that displays the state of the flat-rate container 25A. In step S206, the controller 31 executes a subroutine, illustrated in FIG. 10, that displays the state of the marketed containers 25B.

In step S207, the controller 31 determines whether or not the printer 11 has performed printing or maintenance and has used a printing material. When a printing material has been used, the processing of the controller 31 proceeds to YES in step S207, and the processing proceeds to step S208. In step S208, the controller 31 subtracts the amount used from the stored remaining amounts of the flat-rate container 25A and the marketed container 25B stored in the respective IC chips 34, and writes new current remaining amounts in the respective IC chips 34 so as to update the stored remaining amounts. In step S209, the controller 31 obtains the smallest current remaining amount among the current remaining amounts, which are the smallest amount among the amounts contained in the flat-rate containers 25A as the minimum remaining amount. After the controller 31 executes step S209, the processing of the controller 31 proceeds to step S203.

In step S207, when a printing material has not been used, the processing of the controller 31 proceeds to NO in step S207, and the processing proceeds to step S210. In step S210, the controller 31 determines whether or not a user has operated the power switch 17. When the power switch 17 has not been operated, the processing proceeds NO in step S210, and the processing of the controller 31 proceeds to step S207. When the power switch 17 is operated, the processing of the controller 31 proceeds YES in step S210, the processing is terminated, and the power to the printer 11 is turned off.

Figure 8:
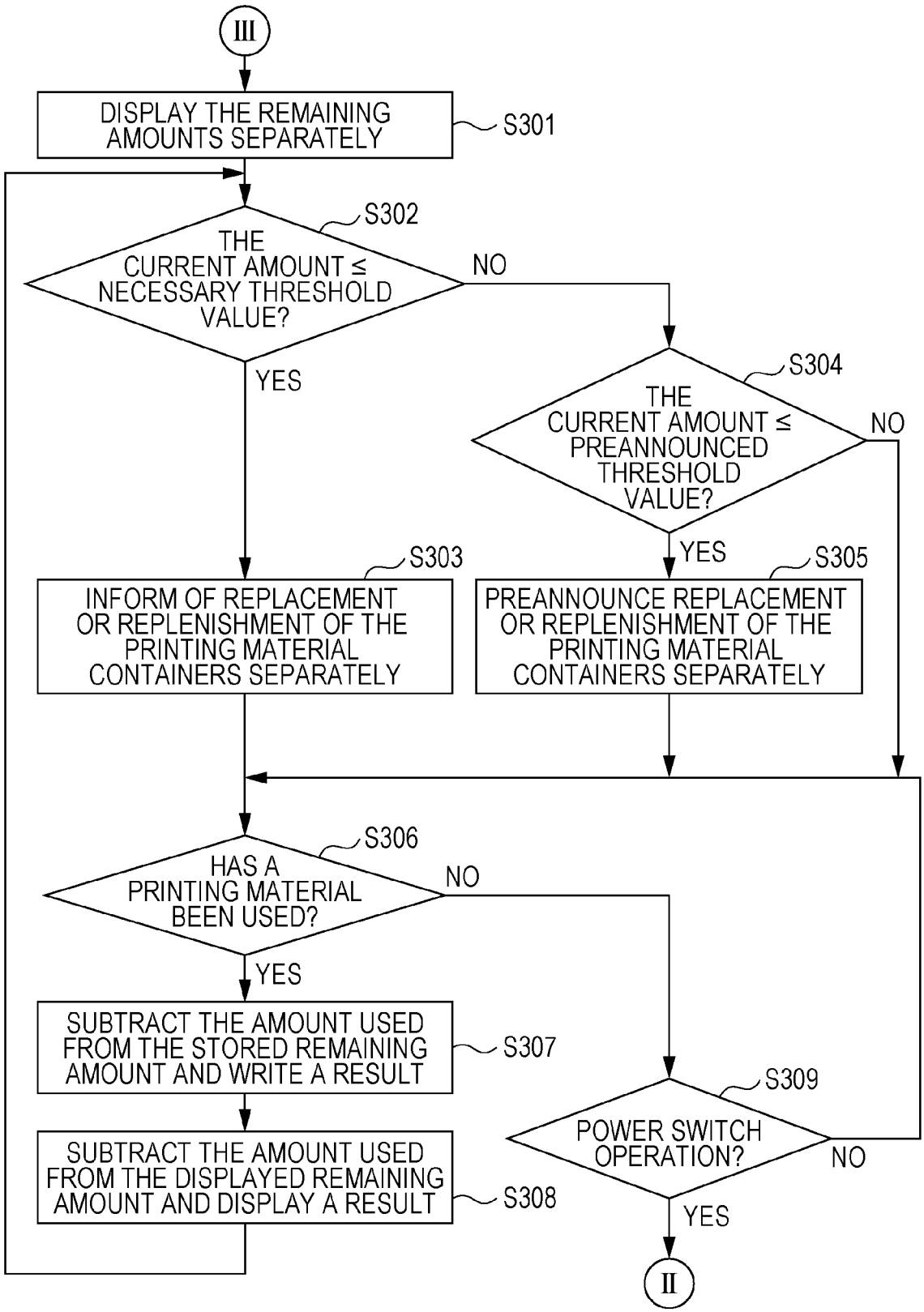
FIG. 8 is a flowchart illustrating the remaining amount display routine.

As illustrated in FIG. 8, in step S301, the controller 31 separately displays the current remaining amounts regardless of whether the printing material container 25 is the flat-rate container 25A or the marketed container 25B. In step S302, the controller 31 determines whether or not the current remaining amount is less than or equal to a necessary threshold value for each of the printing material containers 25. When the remaining amount is less than or equal to the necessary threshold value, the processing of the controller 31 proceeds YES in step S302, and in step S303, the controller 31 displays an empty mark 41 for separately informing of replacement of the printing material container 25 or replenishment.

In step S302, when the remaining amount is larger than a necessary threshold value, the processing of the controller 31 proceeds to NO in step S302, and the processing proceeds to step S304. In step S304, the controller 31 determines whether or not the remaining amount is less than or equal to a preannouncement threshold value. When the remaining amount is less than or equal to the preannouncement threshold value, the processing of the controller 31 proceeds to YES in step S304, and in step S305, the preannouncement mark 40 is displayed for separately preannouncing the time for replacement or replenishment of the printing material container 25. In step S304, when the remaining amount is larger than the preannouncement threshold value, the processing of the controller 31 proceeds to NO in step S304, and the processing proceeds to step S306.

In step S306, the controller 31 determines whether or not the printer 11 has performed printing or maintenance, and a printing material has been used. When a printing material has been used, the processing of the controller 31 proceeds to YES in step S306, and the processing proceeds to step S307. In step S307, the controller 31 subtracts the amount used from the stored remaining amount stored in the IC chip 34 and writes a new current remaining amount in the IC chip 34 so as to update the stored remaining amount, and the processing proceeds to step S308. In step S308, the controller 31 displays the difference when the amount of the printing material used is subtracted from the display remaining amount displayed on the display section 18 as a new display remaining amount, and the processing proceeds to step S302.

In step S306, when no printing material has been used, the processing of the controller 31 proceeds to NO in step S306, and the processing proceeds to step S308. In step S308, the controller 31 determines whether or not a user has operated the power switch 17. When the power switch 17 has not been operated, the processing of the controller 31 proceeds to NO in step S308, and the processing proceeds to step S306. When the power switch 17 is operated, the processing of the controller 31 proceeds to YES in step S308, the processing is terminated, and the power to the printer 11 is turned off.

Next, a description will be given of the state display routine of the flat-rate container 25A, which is performed in step S106 and step S205 in the remaining amount display routine, with reference to a flowchart illustrated in FIG. 9.

AS illustrated in FIG. 9, in step S401, the controller 31 determines whether or not the minimum remaining amount of the flat-rate container 25A is less than or equal to a necessary threshold value. When the minimum remaining amount is less than or equal to the necessary threshold value, the processing of the controller 31 proceeds to YES in step S401, and the processing proceeds to step S402. In step S402, the controller 31 displays an empty mark 41 for informing that all the flat-rate containers 25A among the plurality of printing material containers 25 are necessary to be replaced or replenished, and the processing is terminated.

In step S401, when the minimum remaining amount is larger than a necessary threshold value, the processing of the controller 31 proceeds to NO in step S401, and the processing proceeds to step S404. In step S404, the controller 31 determines whether or not the minimum remaining amount is less than or equal to a preannouncement threshold value. When the minimum remaining amount is less than or equal to the preannouncement threshold value, the processing of the controller 31 proceeds to YES in step S404, and the processing proceeds to step S405. In step S405, the controller 31 displays a preannouncement mark 40 for preannouncing that the time for replacement or replenishment is close for all of the flat-rate containers 25A among the plurality of printing material containers 25.

In step S404, when the minimum remaining amount is larger than the preannouncement threshold value, the processing of the controller 31 proceeds to NO in step S404, and the processing proceeds to step S406. In step S406, the controller 31 determines whether or not the minimum remaining amount is less than or equal to a delivery threshold value. When the minimum remaining amount is less than or equal to the delivery threshold value, the processing of the controller 31 proceeds to YES in step S406, and the processing proceeds to step S407.

In step S407, the controller 31 requests delivery of a replacement container or a replenishment container for all the flat-rate containers 25A among the plurality of printing material containers 25. In step S406, when the minimum remaining amount is larger than the delivery threshold value, the processing of the controller 31 proceeds to NO in step S406, and the processing is terminated.

Figure 10:
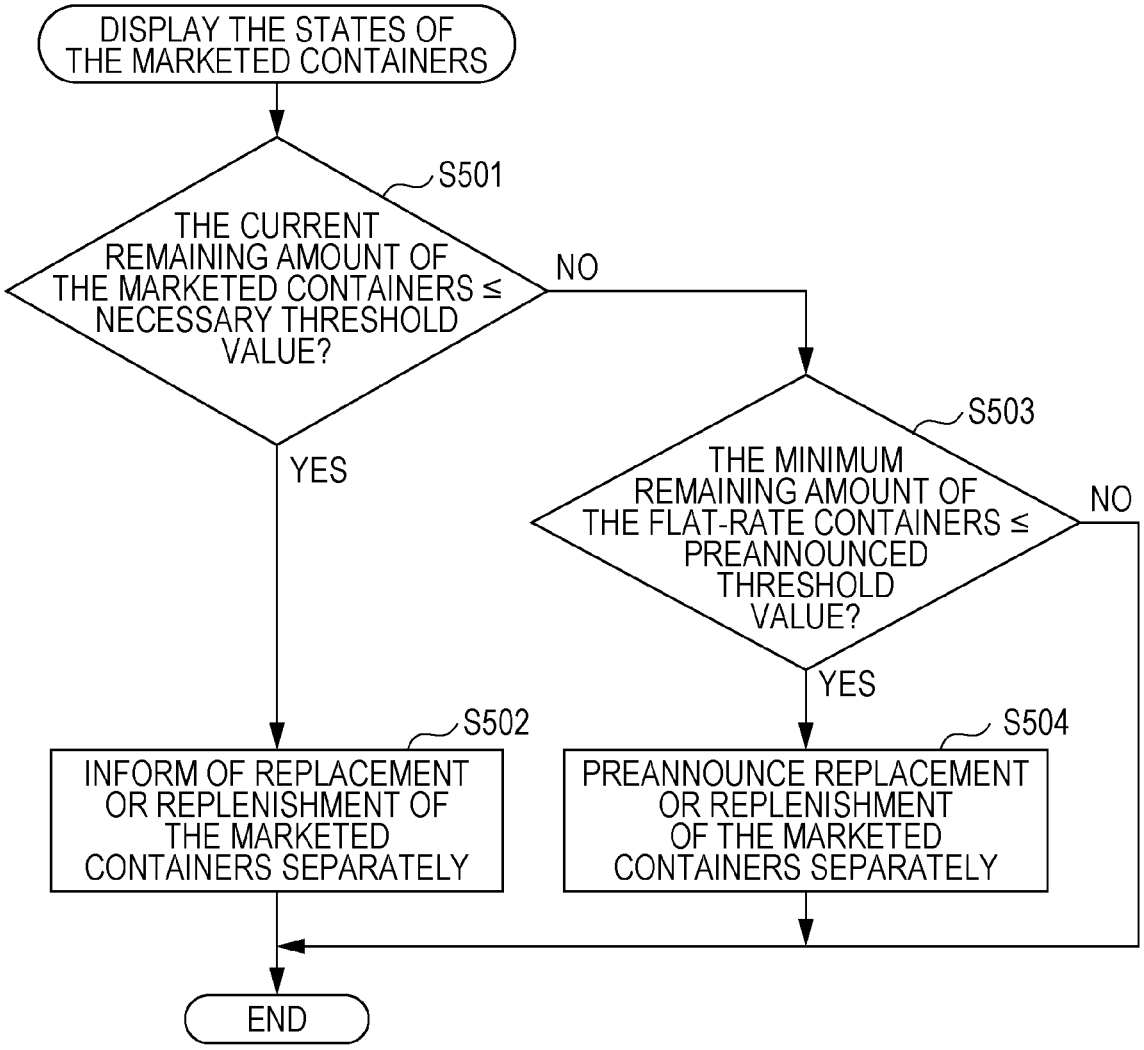
FIG. 10 is a flowchart illustrating a state display routine of a marketed container.

Next, a description will be given of the state display routine of the marketed container 25B, which is executed by step S206 in the remaining amount display routine, with reference to a flowchart illustrated in FIG. 10. As illustrated in FIG. 10, in step S501, the controller 31 determines whether or not the current remaining amount of the marketed container 25B is less than or equal to a necessary threshold value. When the current remaining amount is less than or equal to the necessary threshold value, the processing of the controller 31 proceeds to YES in step S501, and the processing proceeds to step S502. In step S502, the controller 31 separately displays an empty mark 41 for informing of the necessity of replacement or replenishment of the marketed container 25B having the current remaining amount less than or equal to the necessary threshold value, and the processing is terminated.

In step S501, when the current remaining amount of the marketed container 25B is larger than the necessary threshold value, the processing of the controller 31 proceeds to NO in step S501, and the processing proceeds to step S503. In step S503, the controller 31 determines whether or not the current remaining amount of the marketed container 25B is less than or equal to a preannouncement threshold value. When the current remaining amount of the marketed container 25B is less than or equal to the preannouncement threshold value, the processing of the controller 31 proceeds to YES in step S503, and the processing proceeds to step S504. In step S504, the controller 31 displays a preannouncement mark 40 for preannouncing that the time for replacement or replenishment is close for the marketed container 25B having the current remaining amount less than or equal to the preannouncement threshold value, and the processing is terminated. In step S503, when the current remaining amount is larger than the preannouncement threshold value, the processing of the controller 31 proceeds to NO in step S503, and the processing is terminated.

A description will be given of the operation according to the present embodiment. The controller 31 determines whether or not to perform display control depending on whether the printing material container 25 mounted on the mounting section 26 is the flat-rate container 25A or the marketed container 25B.

As illustrated in FIG. 5, when a flat-rate container 25A and a marketed container 25B are mounted on the mounting section 26, a plurality of pieces of container information obtained by the controller 31 includes first information and second information. When a plurality of pieces of container information obtained by the controller 31 include first information and second information, the controller 31 performs display control on the printing material container 25 having the first information out of the plurality of printing material containers 25. That is to say, the controller 31 performs display control on the flat-rate container 25A excluding the marketed container 25B.

In the state illustrated in FIG. 5, among the flat-rate containers 25A, a yellow printing material 43Y has the smallest remaining amount, and a magenta printing material 43M and a cyan printing material 43C have remaining amounts larger than that of the yellow printing material 43Y. Accordingly, the printing material container 25 that contains the yellow printing material 43Y is the first container 25*a* having the smallest remaining amount among the plurality of printing material containers 25, and the printing material containers 25 that contain the magenta printing material 43M and the cyan printing material 43C respectively are the other second containers 25*b*.

In the display control, the controller 31 matches the display of the remaining amounts on the other second containers 25*b* to the display of the remaining amount of the first container 25*a* among the plurality of printing material containers 25. Specifically, the controller 31 matches the heights of the cyan marker 44C and the magenta marker 44M to the height of the yellow marker 44Y indicating the remaining amount of the yellow printing material 43Y.

The controller 31 performs display control, for example, at the time when the power switch 17 is operated, at the time when a printing material container 25 is mounted on the mounting section 26, and when the remaining amount of the first container 25*a* becomes any one of the delivery threshold value, the preannouncement threshold value, and the necessary threshold value. The controller 31 determines that the printing material container 25 having the smallest remaining amount as the first container 25*a* and the other printing material containers 25 as the second containers 25*b* every time the controller 31 performs display control or every time the controller 31 uses the printing material.

When the remaining amount of a printing material contained in the first container 25*a* becomes a delivery threshold value, the controller 31 may cause the transmission section 32 to transmit a request signal of a replacement container that contains the same printing material as that of the first container 25*a* or a replenishment container. The controller 31 may cause the transmission section 32 to transmit a request signal of a replacement container that contains the same printing material as that of the second container 25*b* or a replenishment container together with a request signal of a replacement container that contains the same printing material as that of the first container 25*a* or a replenishment container. That is to say, for example, when the printing material container 25 that contains the yellow printing material 43Y is the first container 25*a*, when the transmission section 32 transmits a request signal that requests for delivery of a replacement container that contains the yellow printing material 43Y or a replenishment container to the server 37, the controller 31 may transmits a request signal that requests delivery of replacement containers that contain the cyan printing material 43C and the magenta printing material 43M respectively or the respective replenishment containers.

When the display section 18 performs display control, the height of the yellow marker 44Y corresponding to the yellow printing material 43Y contained in the first container 25*a*, and the heights of the cyan marker 44C and the magenta marker 44M corresponding to the cyan printing material 43C and the magenta printing material 43M respectively contained in the second container 25*b* are made equal. Accordingly, when the remaining amount of the first container 25*a* becomes a delivery threshold value, a preannouncement threshold value, or a necessary threshold value, and the controller 31 performs display control, the remaining amount of the first container 25*a* and the remaining amount of the second container 25*b* are displayed as the same amount on the display section 18.

When the remaining amount of the first container 25*a* becomes a preannouncement threshold value, the controller 31 may preannounce the necessity of replacement of the first container 25*a* or replenishment of the printing material, and may preannounce the necessity of replacement of the second container 25*b* or replenishment of the printing material. Specifically, the controller 31 may display the preannouncement marks 40 corresponding to the respective yellow marker 44Y, cyan marker 44C, and magenta marker 44M.

When the remaining amount of the first container 25*a* becomes a necessary threshold value, the controller 31 may display respective empty marks 41 corresponding to the yellow marker 44Y, the cyan marker 44C, and the magenta marker 44M for indicating the necessity of replacement of the first container 25*a* and the second container 25*b* or replenishment of the printing materials.

Figure 11:
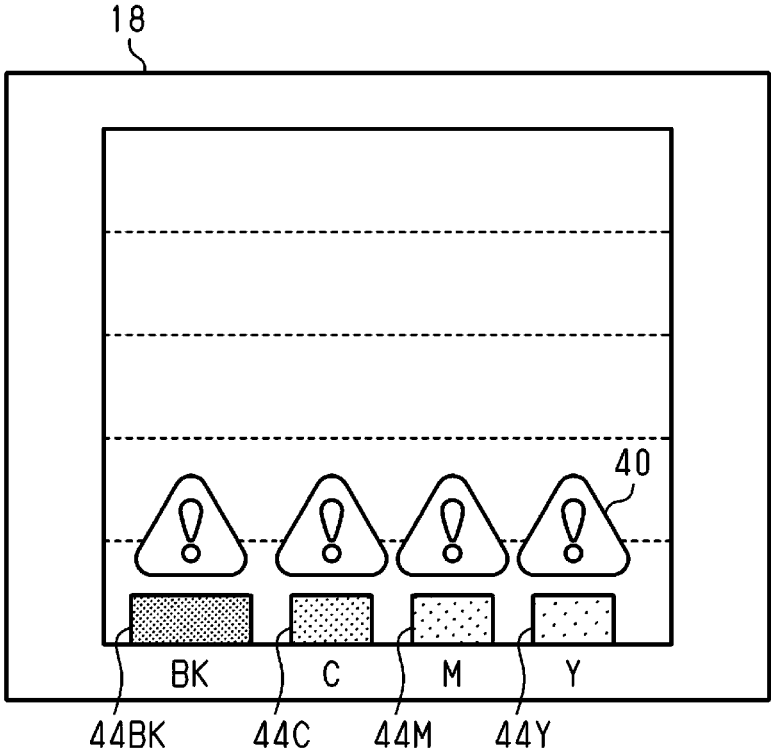
FIG. 11 is a schematic diagram illustrating a display section that displays the remaining amounts of the flat-rate containers.
Figure 12:
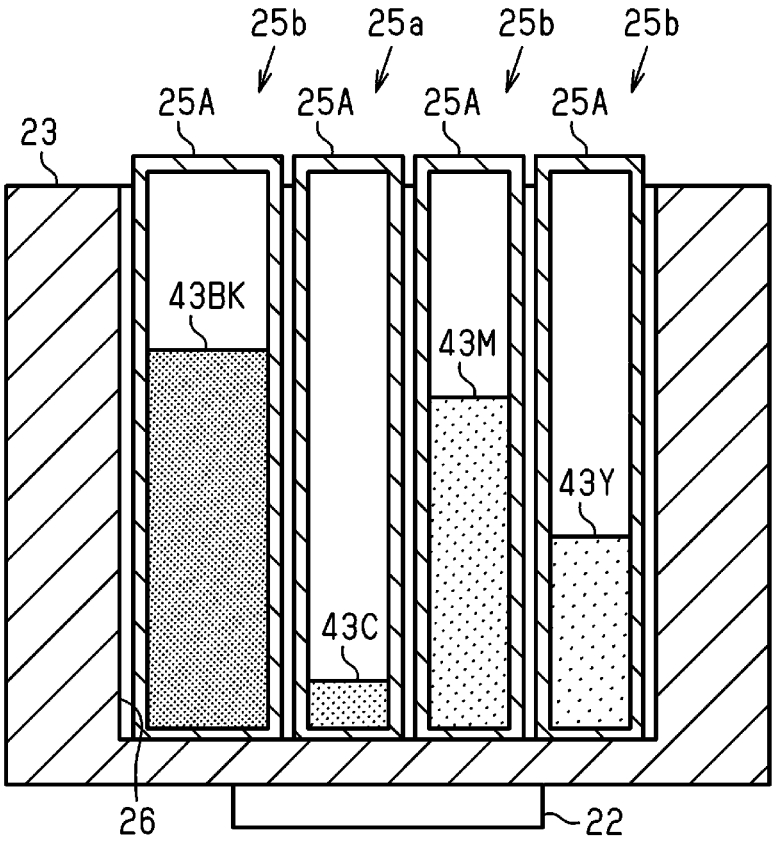
FIG. 12 is a schematic sectional view illustrating the flat-rate containers mounted on the mounting section.

As illustrated in FIGS. 11 and 12, when all of the printing material containers 25 mounted on the mounting section 26 are the flat-rate containers 25A, a plurality of pieces of container information obtained by the controller 31 are all the pieces of the first information. When the container information is all the first information, the controller 31 performs display control on all of the printing material containers 25.

In the state illustrated in FIG. 12, the cyan printing material 43C has the smallest remaining amount, the yellow printing material 43Y and the magenta printing material 43M have smaller remaining amount in this order, and the black printing material 43BK has the largest amount. Accordingly, the printing material container 25 that contains the cyan printing material 43C is the first container 25*a* having the smallest remaining amount among the plurality of printing material container 25, and the respective printing material containers 25 that contain the yellow printing material 43Y, the magenta printing material 43M, and the black printing material 43BK are the other second containers 25*b*.

In display control, the controller 31 matches the display on the remaining amounts of the other second containers 25*b* with the display of the remaining amount of the first container 25*a* out of the plurality of printing material containers 25. Accordingly, the controller 31 matches the respective heights of the black marker 44BK, the magenta marker 44M, and the yellow marker 44Y with the height of the cyan marker 44C.

When the remaining amount of the cyan printing material 43C becomes the delivery threshold value, the controller 31 may transmit a request signal of a replacement container that takes the place of the printing material container 25 containing the cyan printing material 43C or a replenishment container. The controller 31 may transmit a request signal of a replacement container or a replenishment container on the second container 25*b* at the time of transmitting a request signal of a replacement container or a replenishment container on the first container 25*a*.

As illustrated in FIG. 11, when the remaining amount of the cyan printing material 43C becomes the preannouncement threshold value, the controller 31 may display preannouncement marks 40 corresponding to the black marker 44BK, the cyan marker 44C, the magenta marker 44M, and the yellow marker 44Y. Also, the preannouncement marks 40 may not be displayed. When the remaining amount of the cyan printing material 43C remains the smallest and becomes the necessary threshold value, the controller 31 may display empty marks 41 corresponding to the black marker 44BK, the cyan marker 44C, the magenta marker 44M, and the yellow marker 44Y.

Figure 13:
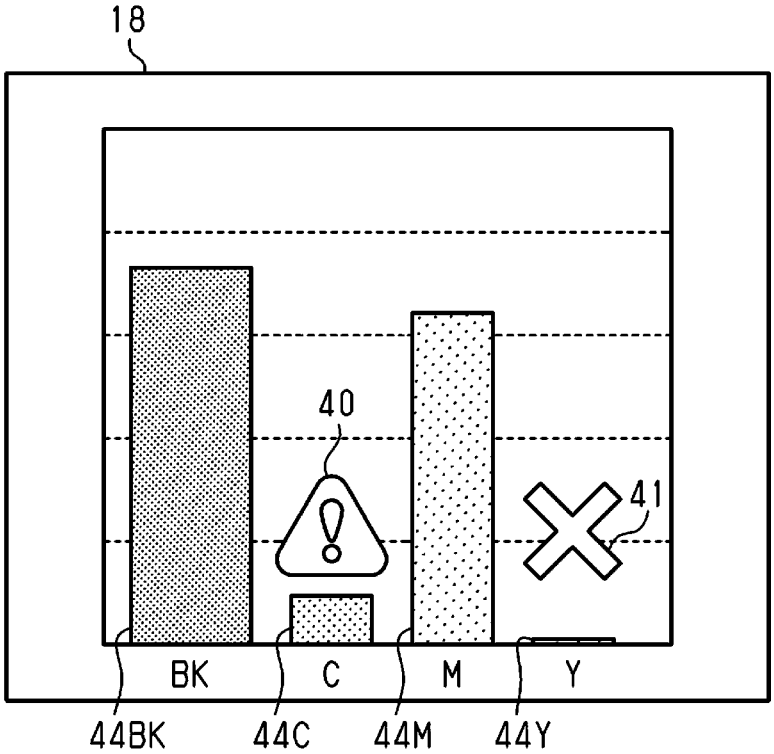
FIG. 13 is a schematic diagram illustrating a display section that displays the remaining amounts of the marketed containers.
Figure 14:
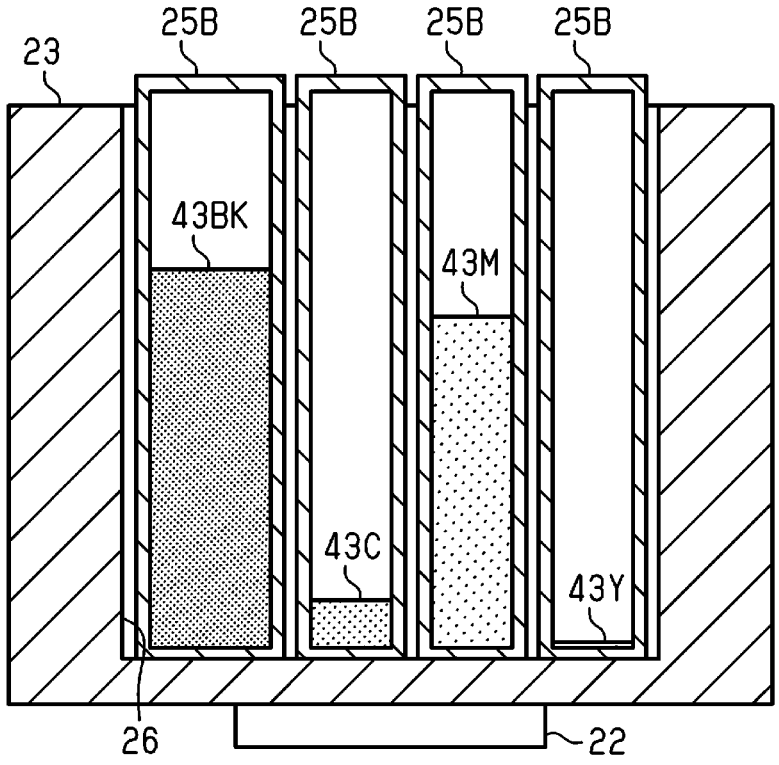
FIG. 14 is a schematic sectional view illustrating the marketed containers mounted on the mounting section.

As illustrated in FIGS. 13 and 14, when the printing material containers 25 mounted on the mounting section 26 are all the marketed containers 25B, a plurality of pieces of the container information obtained by the controller 31 are all the pieces of the second information. When the container information is all the second information, the controller 31 displays the individual remaining amounts regardless of the respective remaining amounts of the plurality of printing material containers.

In the state illustrated in FIG. 14, the remaining amounts of the black printing material 43BK and the magenta printing material 43M are larger than the preannouncement threshold value. The remaining amount of the cyan printing material 43C is smaller than the preannouncement threshold value and larger than the necessary threshold value. The remaining amount of the yellow printing material 43Y is smaller than the necessary threshold value. Accordingly, the controller 31 displays the preannouncement mark 40 in accordance with the cyan marker 44C, and displays the empty mark 41 in accordance with the yellow marker 44Y.

Descriptions will be given of the advantages of the present embodiment.

1. The controller 31 matches the display of the remaining amounts of a plurality of printing material containers 25 with the display of the remaining amount of the first container 25*a* having the smallest remaining amount among the plurality of printing material containers 25. Accordingly, it is possible to prompt a user to perform replacement of a plurality of printing material containers 25 or replenishment of a plurality of printing material containers 25 with the printing materials all at once. Accordingly, compared with the case of separately replacing a plurality of printing material containers 25 or the case of separately replenishing a plurality of printing material container 25 with the corresponding printing materials, it is possible to reduce the number of operations by a user.

2. When the remaining amount of a printing material contained in the first container 25*a* having the smallest remaining amount among a plurality of printing material containers 25 becomes a threshold value, the controller 31 causes the transmission section 32 to transmit a request signal. Accordingly, compared with the case in which a user himself arranges delivery of a replacement container or a replenishment container, it is possible to reduce time and effort of the user.

3. When the controller 31 requests delivery of a replacement container or a replenishment container corresponding to the first container 25*a*, the controller 31 requests delivery of a replacement container or a replenishment container corresponding to the second container 25*b*. Accordingly, it is possible to deliver a plurality of replacement containers or a plurality of replenishment containers all at once.

4. For example, when the display of the remaining amount of the second container 25*b* is matched with the display of the remaining amount of the first container 25*a* in the state in which the remaining amount of the second container 25*b* is displayed on the display section 18, the display on the display section 18 is suddenly changed, and thus a strange feeling might be given to a user. On that point, when the power switch 17 is operated, the controller 31 matches the display of the remaining amount of the second container 25*b* with the display of the remaining amount of the first container 25*a*. That is to say, either the time when the power is turned on, and the remaining amount is displayed on the display section 18 or the time when the power is turned off, and the display on the display section 18 disappears, the controller 31 changes the display of the remaining amount of the second container 25*b*. Accordingly, it is possible to reduce the risk of giving a feeling of strangeness to the user.

5. When the remaining amount of the first container 25*a* becomes a preannouncement threshold value, the controller 31 matches the display of the remaining amount of the second container 25*b* to the display of the remaining amount of the first container 25*a*. Accordingly, it is possible to match the display of the remaining amount of the second container 25*b* at a suitable time for preannouncing the necessity of replacement or replenishment of the first container 25*a*.

6. When the remaining amount of the first container 25*a* becomes a necessary threshold value, the controller 31 matches the display of the remaining amount of the second container 25*b* with the display of the remaining amount of the first container 25*a*. Accordingly, when replacement or replenishment of the first container 25*a* becomes necessary, it is possible to prompt replacement or replenishment of the second container 25*b*.

7. The controller 31 obtains the container information on printing material containers 25 and performs control so as to match the display of the remaining amount of the other second containers 25*b* with the display of the remaining amount of the first container 25*a* having the smallest remaining amount among a plurality of printing material containers 25 having the first information. Accordingly, when the printing section 22 performs printing using the printing materials contained both in the printing material container 25 having the first information and the printing material containers 25 having the second information, it is possible to match the display of the remaining amounts of the printing material containers 25 having the first information with each other.

8. Since the value produced by multiplying time required for delivery and usage speed is set to the delivery threshold value, it is possible to deliver replacement container or a replenishment container to a user when it becomes necessary to replace the printing material container 25 or replenish the printing material.

Second Embodiment

Next, a description will be given of a second embodiment of the printer. In this regard, in the second embodiment, the controller performs control in a different way from that of the first embodiment. The other points are substantially same as those of the first embodiment, and thus the duplicated descriptions will be omitted by giving the same sign to the same configuration.

In the present embodiment, when the processing proceeds to NO in step S103 in the remaining amount display routine, illustrated in FIG. 6 to FIG. 8, in the first embodiment, the processing of the controller 31 proceeds to step S301. That is to say, the flowchart illustrated in FIG. 7 is not used in the second embodiment.

A description will be given of the operation of the present embodiment.

When the obtained plurality of pieces of container information is all the first information, the controller 31 performs display control on all the printing material containers 25 in the same manner as the first embodiment.

When the obtained plurality of pieces of container information includes the first information and the second information, the controller 31 displays the individual remaining amounts instead of the display control regardless of the plurality of respective printing material containers 25. When the flat-rate container 25A and the marketed container 25B are both mounted on the mounting section 26, the controller 31 performs the same control as in the case of containing only the marketed containers 25B in the first embodiment regardless of the number of flat-rate containers 25A.

Descriptions will be given of advantages of the present embodiment.

9. When the obtained container information includes both the first information and the second information, the controller 31 displays the individual remaining amounts regardless of the remaining amounts of the respective printing material containers 25. Accordingly, for example, when the printing section 22 performs printing using printing materials contained in different kinds of printing material containers 25, it is possible to match the actual remaining amount of a printing material contained in the printing material container 25 and the display of the remaining amount displayed on the display section 18.

It is possible to change the present embodiment as follows and carry out the embodiment. It is possible to carry out the present embodiment and the following variations by combining them to the extent that they do not technically conflict with each other.

The container information may represent the kind of a printing material. For example, the printing material container 25 that contains any one of the printing material among the cyan printing material 43C, the magenta printing material 43M, and the yellow printing material 43Y may store the first information, and the printing material container 25 that contains the black printing material 43BK may store the second information.

The container information may represent the difference of the maximum capacity. For example, the printing material container 25 having a small maximum capacity, such as the respective printing material containers 25 that contain the cyan printing material 43C, the magenta printing material 43M, and the yellow printing material 43Y, may store the first information. As the printing material container 25 having a large maximum capacity, such as the printing material container 25 that contains the black printing material 43BK, may store the second information.

The display section 18 may store a matching threshold value higher than the delivery threshold value. The controller 31 may obtain the container information on the printing material container 25 based on the remaining amount and the matching threshold value. For example, the controller 31 compares the remaining amount with a matching threshold value, and when the remaining amount is higher than the threshold value, the controller 31 may obtain the first information, whereas when the remaining amount is lower than the matching threshold value, the controller 31 may obtain the second information. That is to say, the controller 31 may perform display control so as to match display of the remaining amount of the printing material container 25, which is lower than a matching threshold value among the plurality of printing material containers 25. Thereby, for example, it is possible to reduce the risk of displaying the preannouncement mark 40 or the empty mark 41 in the display of the remaining amount of the printing material container 25 that has just been replaced.

The container information may be input to the printer 11 by a user, service personnel, an operator, or the like via a touch panel, an operation button, a network NW, an external device, or the like.

The printer 11 is not limited to an on-carriage type, in which the mounting section 26 is disposed on the carriage 23, and may be an off-carriage type in which the mounting section 26 is disposed separately from the carriage 23. The mounting section 26 may be disposed outside the casing 12.

The printer 11 may include a remaining amount sensor that detects the remaining amount of a printing material contained in the printing material container 25. The controller 31 may obtain the current remaining amount based on the detection result of the remaining amount sensor.

A printing material container 25 having a replenishable printing material may be fixed to the printer 11. That is to say, a printing material may be replenishable in the state in which the printing material container 25 is attached to the printer 11.

The controller 31 may update the remaining amount stored in the IC chip 34 at any time. For example, the controller 31 may store the current remaining amount in the IC chip 34 every time a printing material is used by printing or maintenance.

The controller 31 may perform display control so as to match the display on the remaining amount of the second container 25*b* with the display on the remaining amount of the first container 25*a* for all the printing material containers 25 regardless of the container information.

The controller 31 may not perform display control every time a printing material is used, but may perform display control when the remaining amount of the first container 25*a* becomes a delivery threshold value, when the remaining amount becomes a preannouncement threshold value, or when the remaining amount becomes a necessary threshold value. The controller 31 may perform display control when the power switch 17 is operated, when a printing material container 25 is mounted on the mounting section 26, the remaining amount of the first container 25*a* becomes at least any one of the delivery threshold value, the preannouncement threshold value, and the necessary threshold value. The controller 31 may perform display control at different time from these. The controller 31 may perform display control when a display instruction to display the remaining amount is input to the display section 18. The controller 31 may perform display control when the cover 13 that covers the carriage 23 is closed. The controller 31 may perform display control when the remaining amount decreases based on a detection result of a remaining amount sensor.

The power switch 17 may be a button switch, a slide switch, a pull switch, a toggle switch, or the like. The power switch 17 may be a voice switch, which is operable by voice.

When the minimum remaining amount becomes a delivery threshold value, the controller 31 may inform of the necessity for delivery of a replacement container or a replenishment container. For example, the controller 31 may display a message or a mark on the display section 18 or may give guidance. The printer 11 may not include the transmission section 32. The printer 11 may not be connected to the network NW.

The printer 11 may be a liquid discharge apparatus that performs printing by discharging liquid as a printing material. The state of the liquid discharged from the liquid discharge apparatus as a minute amount droplet includes a granular state, a teardrop shaped state, a trailing filament, or the like. The liquid mentioned here ought to be a material able to be discharged from a liquid discharge apparatus. For example, the liquid ought to have a state in which a material is in a liquid phase. It is assumed that the liquid includes a flow body having a high or low viscosity, such as sol, gel water, the other inorganic solvent, organic solvent, solution, liquid resin, liquid metal, and metal melt. The liquid includes not only a liquid as a state of a material, but also includes the state in which particles of functional materials including a sold body, such as pigment, metal particles, and the like are dissolved, distributed, or mixed in a solvent, and the like. Representative examples include ink, liquid crystal, and the like. It is assumed that the ink here includes a general water-based ink, oily ink, and various liquid compositions, such as gel ink, hot melt ink, and the like. Specific examples of the liquid discharge apparatus include, for example, a liquid crystal display, an electroluminescent display, a surface emitting display, and apparatuses for use in producing a color filter, and the like that discharge liquid including electrode materials, color materials, and the like in a dispersed or dissolved manner.

The printer 11 may be an electrophotographic laser printer. A printing material used for a laser printer is toner.

The printer 11 may be a thermal transfer printer or a dot impact printer. A printing material used for a thermal transfer printer and a dot impact printer are respective ink ribbons.

The printer 11 may be a 3D printer. Printing materials used for a 3D printer include a filament, a binder, and the like.

The printer 11 may be an ink jet printer that performs printing by discharging ink, which is a printing material, or a digital printing machine that performs printing by putting ink on a plate. The printer 11 may be an offset printer, a textile printer, an intaglio printing, or the like. The ink jet printer may be a serial printer, a lateral printer, a line printer, a page printer, or the like.

In the following, descriptions will be given of the technical ideas and the advantages obtained from the above-described embodiments and variations.

A. A printer includes: a printing section configured to perform printing using a plurality of printing materials contained in corresponding printing material containers, a display section configured to display respective remaining amounts of the individual printing materials contained in the corresponding printing material containers; and a controller configured to control display on the display section, wherein the controller performs display control so as to match the display on the remaining amount of a second container other than the first container with the display on the remaining amount of a first container having a smallest remaining amount among the plurality of the printing material containers.

With this configuration, the controller matches the display of the remaining amounts of a plurality of printing material containers with the display of the remaining amount of the first container having the smallest remaining amount among the plurality of printing material containers. Accordingly, it is possible to prompt a user to perform replacement of a plurality of printing material containers or replenishment of a plurality of printing material containers with the printing materials all at once. Accordingly, compared with the case of separately replacing a plurality of printing material containers or the case of separately replenishing a plurality of printing material container with the corresponding printing materials, it is possible to reduce the number of operations by a user.

B. The printer further includes: a transmission section configured to transmit a request signal requesting delivery of a replacement container for replacing the printing material container or a replenishment container containing a printing material for replenishing the printing material container to a server on a network, wherein when the remaining amount of the printing material contained in the first container becomes a delivery threshold value, the controller may cause the transmission section to transmit the request signal of the replacement container containing the printing material same as that of the first container or the replenishment container containing the printing material same as that of the first container.

With this configuration, when the remaining amount of a printing material contained in the first container having the smallest remaining amount among a plurality of printing material containers becomes a threshold value, the controller may cause the transmission section to transmit a request signal. Accordingly, compared with the case in which a user himself arranges delivery of a replacement container or a replenishment container, it is possible to reduce time and effort of the user.

C. In the printer, when the remaining amount of the printing material contained in the first container becomes the delivery threshold value, the controller may cause the transmission section to transmit both the request signal of the replacement container containing the printing material same as that of the first container or the replenishment container containing the printing material same as that of the first container and the request signal of the replacement container containing the printing material same as that of the second container or the replenishment container containing the printing material same as that of the second container.

With this configuration, when the controller requests delivery of a replacement container or a replenishment container corresponding to the first container, the controller may request delivery of a replacement container or a replenishment container corresponding to the second container. Accordingly, it is possible to deliver a plurality of replacement containers or a plurality of replenishment containers all at once.

D. In the printer, when a power switch is operated, the controller may perform the display control. For example, when the display of the remaining amount of the second container is matched with the display of the remaining amount of the first container in the state in which the remaining amount of the second container is displayed on the display section, the display on the display section is suddenly changed, a strange feeling might be given to a user. On that point, when the power switch is operated, the controller may match the display of the remaining amount of the second container with the display of the remaining amount of the first container. That is to say, either the time when the power is turned on, and the remaining amount is displayed on the display section or the time when the power is turned off, and the display on the display section disappears, the controller changes the display of the remaining amount of the second container. Accordingly, it is possible to reduce the risk of giving a feeling of strangeness to the user.

E. In the printer, when the remaining amount of the first container becomes a preannouncement threshold value larger than a necessary threshold value at which the first container needs to be replaced or the printing material needs to be replenished, the controller may perform the display control.

With this configuration, when the remaining amount of the first container becomes a preannouncement threshold value, the controller may match the display of the remaining amount of the second container to the display of the remaining amount of the first container. Accordingly, it is possible to match the display of the remaining amount of the second container at a suitable time for preannouncing the necessity of replacement or replenishment of the first container.

F. In the printer, when the remaining amount of the first container becomes a necessary threshold value at which the first container needs to be replaced or the printing material needs to be replenished, the controller may perform the display control.

With this configuration, when the remaining amount of the first container becomes a necessary threshold value, the controller may match the display of the remaining amount of the second container with the display of the remaining amount of the first container. Accordingly, when replacement or replenishment of the first container becomes necessary, it is possible to prompt a user to replace or replenish the second container.

G. In the printer, the controller is configured to obtain container information regarding each of the plurality of the printing material containers, when obtained plurality pieces of the container information is all first information, the controller may perform the display control for all of the printing material containers, and when obtained plurality pieces of the container information includes the first information and second information, the controller may perform the display control for the printing material container having the first information among the plurality of the printing material containers.

With this configuration, the controller obtains the container information on the printing material containers and performs control so as to match the display of the remaining amount of the other second containers with the display of the remaining amount of the first container having the smallest remaining amount among a plurality of printing material containers having the first information. Accordingly, when the printing section performs printing using the printing materials contained in both the printing material container having the first information and the printing material container having the second information, it may be possible to match the display of the remaining amounts of the printing material containers having the first information with each other.

H. In the printer, the controller is configured to obtain container information regarding each of the plurality of the printing material containers, when obtained plurality pieces of the container information is all first information, the controller may perform the display control for all of the printing material containers, and when obtained plurality pieces of the container information includes the first information and second information, the controller may individually display the remaining amounts regardless of the individual remaining amounts of the plurality of the printing material containers instead of the display control.

With this configuration, when the obtained container information includes both the first information and the second information, the controller may display the individual remaining amounts regardless of the remaining amounts of the respective printing material containers. Accordingly, for example, when the printing section performs printing using printing materials contained in different kinds of printing material containers, it is possible to match the actual remaining amount of a printing material contained in the printing material container and the display of the remaining amount displayed on the display section.

What is claimed is:

1. A printer comprising:

a printing section configured to perform printing using a plurality of printing materials contained in corresponding printing material containers, a display section configured to display respective remaining amounts of the individual printing materials contained in the corresponding printing material containers; and a controller configured to control the display on the display section, wherein the controller matches the display of the remaining amount of a second container other than a first container with the display of the remaining amount of the first container having a smallest remaining amount among the plurality of the printing material containers.

2. The printer according to claim 1, further comprising:

a transmission section configured to transmit a request signal requesting delivery of a replacement container for replacing the printing material container or a replenishment container containing a printing material for replenishing the printing material container to a server on a network, wherein when the remaining amount of the printing material contained in the first container becomes a delivery threshold value, the controller causes the transmission section to transmit the request signal of the replacement container containing the printing material same as that of the first container or the replenishment container containing the printing material same as that of the first container.

3. The printer according to claim 2, wherein when the remaining amount of the printing material contained in the first container becomes the delivery threshold value, the controller causes the transmission section to transmit both the request signal of the replacement container containing the printing material same as that of the first container or the replenishment container containing the printing material same as that of the first container and the request signal of the replacement container containing the printing material same as that of the second container or the replenishment container containing the printing material same as that of the second container.

4. The printer according to claim 1, wherein when a power switch is operated, the controller controls the display of the remaining amount of the first container and the second container.

5. The printer according to claim 1, wherein when the remaining amount of the first container becomes a preannouncement threshold value larger than a necessary threshold value at which the first container needs to be replaced or the printing material needs to be replenished, the controller controls the display of the remaining amount of the first container and the second container.

6. The printer according to claim 1, wherein when the remaining amount of the first container becomes a necessary threshold value at which the first container needs to be replaced or the printing material needs to be replenished, the controller controls the display of the remaining amount of the first container and the second container.

7. The printer according to claim 1, wherein the controller is configured to obtain container information regarding each of the plurality of the printing material containers, when obtained container information is all first information, the controller controls the display of the remaining amount of the print material for all of the printing material containers, and when obtained container information includes the first information and second information, the controller controls the display of the remaining amount of the print material for the printing material container having the first information among the plurality of the printing material containers.

8. The printer according to claim 1, wherein the controller is configured to obtain container information regarding each of the plurality of the printing material containers, when obtained container information is all first information, the controller controls the display of the remaining amount of the print material for all of the printing material containers, and when obtained container information includes the first information and second information, the controller individually displays the remaining amounts regardless of the individual remaining amounts of the plurality of the printing material containers instead of the display control.

* * * * *